US008073703B2

(12) United States Patent
Miyasaka et al.

(10) Patent No.: US 8,073,703 B2
(45) Date of Patent: Dec. 6, 2011

(54) ACOUSTIC SIGNAL PROCESSING APPARATUS AND ACOUSTIC SIGNAL PROCESSING METHOD

(75) Inventors: Shuji Miyasaka, Osaka (JP); Yoshiaki Takagi, Kanagawa (JP); Takeshi Norimatsu, Hyogo (JP); Akihisa Kawamura, Osaka (JP); Kojiro Ono, Osaka (JP); Kok Seng Chong, Singapore (SG)

(73) Assignee: Panasonic Corporation, Osaka (JP)

( * ) Notice: Subject to any disclaimer, the term of this patent is extended or adjusted under 35 U.S.C. 154(b) by 865 days.

(21) Appl. No.: 12/066,618

(22) PCT Filed: Oct. 3, 2006

(86) PCT No.: PCT/JP2006/319757

§ 371 (c)(1),
(2), (4) Date: Mar. 12, 2008

(87) PCT Pub. No.: WO2007/043388

PCT Pub. Date: Apr. 19, 2007

(65) Prior Publication Data

US 2009/0240503 A1 Sep. 24, 2009

(30) Foreign Application Priority Data

Oct. 7, 2005 (JP) ..... 2005-295577

(51) Int. Cl.
*G10L 19/00* (2006.01)

(52) U.S. Cl. ..... 704/500; 704/270; 704/501; 704/502; 704/503; 704/504

(58) Field of Classification Search ..... None
See application file for complete search history.

(56) References Cited

U.S. PATENT DOCUMENTS 6,697,491 B1 2/2004 Griesinger
(Continued)

FOREIGN PATENT DOCUMENTS

| | | |
|---|---|---|
| JP | 2-113499 | 9/1990 |
| JP | 4-298200 | 10/1992 |
| JP | 2004-507904 | 3/2004 |

OTHER PUBLICATIONS

International Search Report issued Jan. 9, 2007 in the International (PCT) Application of which the present application is the U.S. National Stage.

(Continued)

*Primary Examiner* — Leonard Saint Cyr
(74) *Attorney, Agent, or Firm* — Wenderoth, Lind & Ponack, L.L.P.

(57) ABSTRACT

To provide an acoustic signal processing apparatus which can reduce the amount of calculation in matrix arithmetic. An acoustic signal processing apparatus converts down-mixed acoustic signals of NI channels to acoustic signals of NO channels, where NO>NI. The acoustic signal processing apparatus includes: a first matrix arithmetic unit for performing arithmetic on a matrix with K rows and NI columns, where NO>K≧NI, for the down-mixed acoustic signals of the NI channels, and outputting K signals obtained after the matrix arithmetic; K decorrelation units for generating signals incoherent, in terms of time characteristics, with the signals obtained after the matrix arithmetic, while maintaining frequency characteristics of the signals obtained after the matrix arithmetic; and a second matrix arithmetic unit for performing arithmetic on a matrix with NO rows and (NI+K) columns for the down-mixed acoustic signals of the NI channels and for the K incoherent signals, and outputting the acoustic signals of the NO channels.

6 Claims, 13 Drawing Sheets

U.S. PATENT DOCUMENTS

| | | | | |
|---|---|---|---|---|
| 7,391,869 | B2 * | 6/2008 | Eid et al. | 381/22 |
| 2004/0086130 | A1 * | 5/2004 | Eid et al. | 381/20 |
| 2004/0125967 | A1 * | 7/2004 | Eid et al. | 381/99 |
| 2005/0007262 | A1 * | 1/2005 | Craven et al. | 341/50 |
| 2005/0157883 | A1 * | 7/2005 | Herre et al. | 381/17 |
| 2006/0009225 | A1 * | 1/2006 | Herre et al. | 455/450 |
| 2006/0029239 | A1 * | 2/2006 | Smithers | 381/119 |
| 2007/0055510 | A1 * | 3/2007 | Hilpert et al. | 704/230 |

OTHER PUBLICATIONS

J. Herre et al., "*The Reference Model Architecture for MPEG Spatial Audio Coding*", 118th AES Convention, Barcelona, Audio Engineering Society Convention, May 28, 2005.

ISO/IEC JTC 1/SC 29/WG11 N7136 "*Text of Working Draft for Spatial Audio Coding*", Apr. 2005, Busan, Korea.

* cited by examiner

ACOUSTIC SIGNAL PROCESSING APPARATUS AND ACOUSTIC SIGNAL PROCESSING METHOD

TECHNICAL FIELD

The present invention relates to an acoustic signal processing apparatus, an acoustic signal processing method, and particularly to a technology for converting down-mixed acoustic signals of NI channels to acoustic signals of NO (NO>NI) channels.

BACKGROUND ART

In recent years, a technology called Spatial Codec has been developed. This technology is designed to compress and encode multichannel realism on the basis of an extremely small amount of information. For example, the AAC method, which is a multichannel codec already widely used as an audio method for digital television, requires a bit rate such as 512 kbps or 384 kbps for 5.1 channels. On the other hand, the Spatial Codec aims to compress and encode multichannel signals at an extremely low bit rate such as 128 kbps, 64 kbps, or even 48 kbps. International standardization activities to achieve this aim are ongoing by the MPEG audio standardization conference, and so-called Reference Model Zero (also referred to as "RM0" hereafter) which is a basic processing method for the spatial audio codec is disclosed (see Non-patent document 1).

Here, an explanation is given as to a basic principle of the Spatial Codec.

FIG. 1 is a diagram for explaining the basic principle of the Spatial Codec in the case of two channels of L and R as an example.

In an encoding process, a spatial audio encoder obtains a down-mixed signal S (S=(L+R)/2), a level difference c, and a phase difference θ through complex calculations based on acoustic signals from the two channels of L and R, as shown in FIG. 1(*a*). The down-mixed signal S is further encoded, together with the level difference c and the phase difference θ, by an encoding apparatus manufactured under the standard such as the MPEG AAC standard.

In a decoding process, a decorrelated signal D, which is orthogonal to the down-mixed signal S and carries reverberations, is generated as shown in FIG. 1(*b*).

Then, as shown in FIG. 1(*c*), the down-mixed signal S and the decorrelated signal D are mixed so that acoustic signals of the two channels of L and R that satisfy the relationship of a parallelogram shown in FIG. 1(*a*) are generated on the basis of the decoded level difference c and the decoded phase difference θ.

The explanation has been given here for the case where two channels are down mixed to one channel and one channel is multiplied to two channels. By repeating this principle a plural number of times, 5.1 channels can be down mixed to two channels, and the two channels can be multiplied to the 5.1 channels, for example.

Next, an explanation is given as to a signal flow in the case of RM0.

FIG. 2 is a block diagram showing a functional structure of an acoustic signal processing apparatus 900 which converts two-channel signals to five-channel signals, the conversion being an example of a basic signal flow in the case of RM0.

Here, note that inputs of the two channels are down-mixed from original five-channel signals and that outputs of the five channels are restored to the original five-channel signals.

Also note that the two-channel signals refer to signals usually outputted respectively from front left and right speakers and that the five-channel signals refer to signals usually outputted respectively from front left and right speakers, rear left and right speakers, and a front center speaker.

As shown in FIG. 2, the acoustic signal processing apparatus 900 includes a pre-mixing matrix M1 (901), decorrelators (also described as "De correlators" or "Decorrelators") 902 and 903, and a post-mixing matrix M2 (904).

The pre-mixing matrix M1 (901) converts the inputs of an input 1 and an input 2 to five-channel signals through a process whereby matrix arithmetic related to gain control is performed on the inputs. Out of the five-channel signals, signals of two channels are respectively converted to incoherent signals through processes performed by the decorrelators 902 and 903. The post-mixing matrix M2 (904) generates the outputs of the five-channel signals through a process whereby matrix arithmetic related to phase control is performed on signals of five channels in total, including the signals of the two channels converted by the decorrelators 902 and 903 and the unconverted signals of the remaining three channels.

FIG. 3 is a block diagram showing a more detailed functional structure of the acoustic signal processing apparatus 900. It should be noted here that although FIG. 2 shows the signals flow from left to right, FIG. 3 shows the signals flow from right to left. Since the insides of the pre-mixing matrix M1 (901) and the post-mixing matrix M2 (904) are defined by the matrix arithmetic, the diagram of FIG. 3 is illustrated to show that the signals flow from right to left only in order for mathematical expressions of matrix arithmetic expressions to agree with the flow of the signals. Thus, the diagram is essentially the same as that of FIG. 2.

In addition to the pre-mixing matrix M1 (901), the decorrelators 902 and 903, and the post-mixing matrix M2 (904) described above, the acoustic signal processing apparatus 900 further includes two determinant generation units 905 and 907, and two interpolation units 906 and 908.

As shown in FIG. 3, the signal processing for the pre-mixing matrix M1 (901) is realized by a determinant of a five-row*two-column matrix. In general, a determinant shown below as Equation (1) is defined as an example of the pre-mixing matrix M1 (901).

[Equation 1]

$$R_1^{l,m} = \gamma^{l,m}\frac{1}{3}\begin{bmatrix} \alpha^{l,m}+2 & \beta^{l,m}-1 & 1 \\ \alpha^{l,m}-1 & \beta^{l,m}+2 & 1 \\ (1-\alpha^{l,m})\sqrt{2} & (1-\beta^{l,m})\sqrt{2} & -\sqrt{2} \\ \alpha^{l,m}+2 & \beta^{l,m}-1 & 1 \\ \alpha^{l,m}-1 & \beta^{l,m}+2 & 1 \end{bmatrix}, \quad (1)$$

In Equation (1), α and β are values obtained from acoustic spatial coefficients called CPC (Channel Prediction Coefficients), and γ is a value obtained from an acoustic spatial coefficient called an ICC (Inter Channel Correlation).

Additionally, a superscript I indicates that the data comes from an $I^{th}$ parameter set (an aggregate of compressed and encoded parameters). Also, a superscript m indicates that the data comes from an $m^{th}$ frequency band. Details of their respective meanings are omitted here since they are not related to the scope of the present invention.

Equation (1) is a determinant of a five-row*three-column matrix, in which the third column has a meaning only when so-called Residual Coding described in Non-patent document 1 is performed. In most cases, Residual Coding is not performed usually in view of restriction on the bit rate and reduction in the decoding arithmetic load. In such a case, Equation (1) can be considered as Equation (2) below.

[Equation 2]

$$R_1^{l,m} = \gamma^{l,m}\frac{1}{3}\begin{bmatrix} \alpha^{l,m}+2 & \beta^{l,m}-1 \\ \alpha^{l,m}-1 & \beta^{l,m}+2 \\ (1-\alpha^{l,m})\sqrt{2} & (1-\beta^{l,m})\sqrt{2} \\ \alpha^{l,m}+2 & \beta^{l,m}-1 \\ \alpha^{l,m}-1 & \beta^{l,m}+2 \end{bmatrix} \quad (2)$$

To be more specific, Equation (2) corresponds to the determinant shown on the right-hand part of FIG. 3. It is obvious that, when Residual Coding is performed, the determinant shown on the right-hand part of FIG. 3 is to be a determinant of a five-row*three-column matrix according to Equation (1) and a Residual Signal is added as an input signal so that there would be three channels.

Out of the five-channel signals generated as described so far, signals of two channels are respectively converted to incoherent signals through processes performed by the decorrelators 902 and 903. The signals of the five channels in total, including the signals of the two channels converted in this way and the unconverted signals of the remaining three channels, are converted through the process of the post-mixing matrix M2 (904), so that the five-channel signals are generated as outputs. This signal processing is realized by a five-row*five-column matrix arithmetic expression.

For the sake of simplification, a five-row*five-column matrix arithmetic expression is given as one example here. Note that this is intended for the case of five channels including front two channels, rear two channels, and a center channel. Thus, when an LFE channel is added, the matrix of this determinant would have six rows and five columns. Moreover, when a decorrelator is used for a so-called Ttt Element described in Non-patent document 1, the matrix of this determinant would have six rows and six columns since one channel is added to the input side of the present matrix arithmetic.

Here, elements (coefficients) of each determinant in the matrix arithmetic are generated on the basis of parameters encoded from the channel level differences, the inter-channel correlations (phase differences), and the channel prediction coefficients among the original five-channel signals.

First, information of the encoded channel level differences, inter-channel correlations (phase differences), and channel prediction coefficients is decoded, so as to obtain the channel level differences, the inter-channel phase differences, and the prediction coefficients which are required when the determinant generation units 905 and 907 divide the two-channel signals into the five-channel signals.

These encoded signals are updated for each frame, which is a predetermined time interval. For this reason, the interpolation units 906 and 908 perform smoothing on the values of the level difference and the phase difference in order to smooth out variations between a current frame and a preceding frame. In this way, each element of the matrix arithmetic expressions of the pre-mixing matrix M1 (901) and the post-mixing matrix M2 (904) is determined. The process of determining each element of the matrix arithmetic expressions is not particularly related to the scope of the present invention and, therefore, the detailed explanation is omitted here.

Moreover, Non-patent document 1 describes that the processing performed by the decorrelators 902 and 903 is to generate a signal incoherent with the input signal in terms of temporal characteristics while maintaining frequency characteristics of the input signal, and also describes that lattice all-pass filters are used as a method.

Non-patent document 1: J. Herre, et al, "The Reference Model Architecture for MPEG Spatial Audio Coding", 118th AES Convention, Barcelona, May 28-31, 2005, Audio Engineering Society Convention Paper 6447.

SUMMARY OF THE INVENTION

Problems that Invention is to Solve

The above-described acoustic signal processing apparatus 900, however, has the following problem.

To be more specific, since both the pre-mixing matrix M1 (901) and the post-mixing matrix M2 (904) are realized by the matrix arithmetic using the large-size determinants, a first problem is that an enormous amount of product-sum calculation is required.

Moreover, since the interpolation units 906 and 908 perform the smoothing for each frame with respect to the preceding frame, a second problem is that an enormous amount of calculation is required.

Furthermore, since the lattice all-pass filter used in the processing performed by the decorrelators 902 and 903 includes a multi-tap IIR filter, a third problem is that an enormous amount of calculation is required.

The present invention is conceived in view of the stated conventional problems, and a first object is to provide an acoustic signal processing apparatus and an acoustic signal processing method which can reduce the amount of calculation required for the matrix arithmetic.

Moreover, a second object is to provide an acoustic signal processing apparatus and an acoustic signal processing method which can reduce the amount of calculation required for the interpolation processing.

Furthermore, a third object is to provide an acoustic signal processing apparatus and an acoustic signal processing method which can reduce the amount of calculation required for the decorrelation processing.

Means to Solve the Problems

In order to solve the above-mentioned first problem, an acoustic signal processing apparatus of the present invention includes: a first matrix arithmetic unit which performs arithmetic on a matrix with K rows and NI columns, where NO>K≧NI, for the down-mixed acoustic signals of the NI channels, and outputs K signals obtained after the matrix arithmetic; K decorrelation units which generate signals incoherent, in terms of time characteristics, with the signals obtained after the matrix arithmetic, while maintaining frequency characteristics of the signals obtained after the matrix arithmetic; and a second matrix arithmetic unit which performs arithmetic on a matrix with NO rows and (NI+K) columns for the down-mixed acoustic signals of the NI channels and for the K incoherent signals, and outputs the acoustic signals of the NO channels.

The number of rows of a determinant of the pre-mixing matrix M1 in the conventional case of RM0 is NO which is always larger than K that is the number of decorrelators. However, according to the present invention, the number of rows of a determinant of the first matrix arithmetic unit is reduced to the same number as K which is the number of the decorrelators, thereby significantly reducing the amount of calculation.

Also, the acoustic signal processing apparatus according to the present invention can be characterized by that K is equal to NI.

Suppose that, in the case of RM0, the pre-mixing matrix M1 calculates a determinant with a five-row*two-column size, for example, and that the post-mixing matrix M2 calculates a determinant with a five-row*five-column size, for example. When applying this to the present invention, the first matrix arithmetic unit is to calculate a small-size determinant of a two-row*two-column matrix and the second matrix arithmetic unit is to calculate a small-size determinant of a five-row*four-column matrix. Thus, the amount of calculation can be further reduced.

Moreover, in order to solve the above-mentioned second problem, the acoustic signal processing apparatus of the present invention can be characterized by including a first determinant generation unit which generates each coefficient of a first determinant of the first matrix arithmetic unit from a parameter updated for each of frames separated by a predetermined time interval; a second determinant generation unit which generates each coefficient of a second determinant of the second matrix arithmetic unit from the parameter; and an interpolation unit which calculates each coefficient of the second determinant of the second matrix arithmetic unit by sequentially performing interpolation using a parameter of an immediately preceding frame or each coefficient of a second determinant of the immediately preceding frame.

With this, the interpolation processing for each element of a determinant is performed only on the second determinant of the second matrix arithmetic unit. To be more specific, the interpolation processing for each element of the first determinant of the first matrix arithmetic unit, which is unnecessary in terms of the hearing sense, is skipped. Therefore, the amount of calculation can be further reduced.

Furthermore, in order to solve the above-mentioned third problem, the acoustic signal processing apparatus of the present invention can be characterized by that the K decorrelation units perform a process to rotate a phase of an input signal by 90 degrees.

With this, K number of decorrelation units can be structured in an extremely simple manner. Thus, the amount of calculation can be further reduced.

Also, the acoustic signal processing apparatus according to the present invention can be characterized by that: the first determinant with K rows and NI columns used in the matrix arithmetic of the first matrix arithmetic unit is formed only by minimum-unit coefficients that are related to gain control and are necessary to the decorrelation units, the coefficients being obtained by separating coefficients that are related to the gain control and are unnecessary to the decorrelation units from coefficients related to the gain control; and the second determinant of NO rows and (NI+K) columns used in the matrix arithmetic of the second matrix arithmetic unit is formed by coefficients which are obtained by combining: the coefficients that are related to the gain control and are unnecessary to the decorrelation units; and coefficients related to phase control.

With this, while the amount of calculation is reduced, high-quality acoustic signals of NO channels can be outputted without crosstalk into other channels.

It should be noted here that the present invention can be realized not only as such an acoustic signal processing apparatus, but also as: an acoustic signal processing method which has the characteristic units of the acoustic signal processing apparatus as its steps; and a program which causes a computer to execute these steps. It should be obvious that such a program can be distributed via a recording medium such as a CD-ROM or via a transmission medium such as the Internet.

Effects of the Invention

As apparent from the above explanation, the acoustic signal processing apparatus and the acoustic signal processing method according to the present invention have the effect of reducing the amount of calculation and thus allowing even a processor with low arithmetic performance to reproduce high-quality surround sound.

Thus, according to the present invention, places for watching and listening are not limited to fixed locations, and can be mobile units such as an automobile. On the account of this, the practical value of the present invention is extremely high in these days where distribution of contents, such as music, has become widespread.

NUMERICAL REFERENCES

Figure 1A:
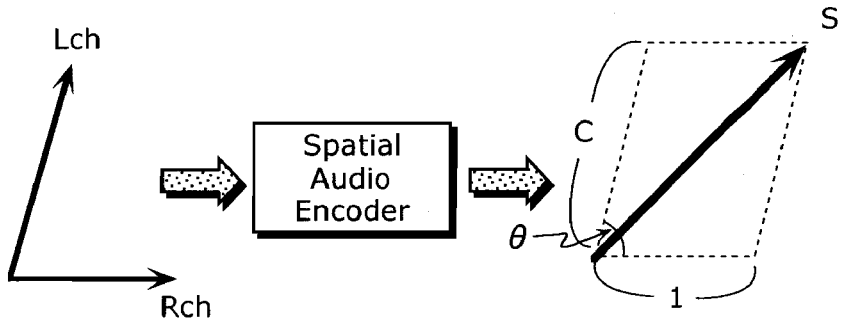
FIG. 1 is a diagram for explaining about the basic principle of Spatial Codec in the case of two channels of L and R as an example.
Figure 1B:
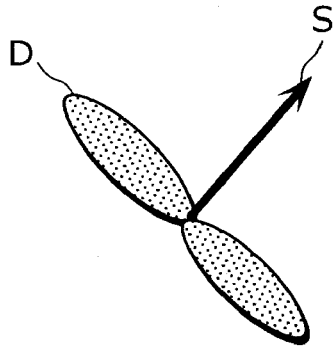
Figure 1C:
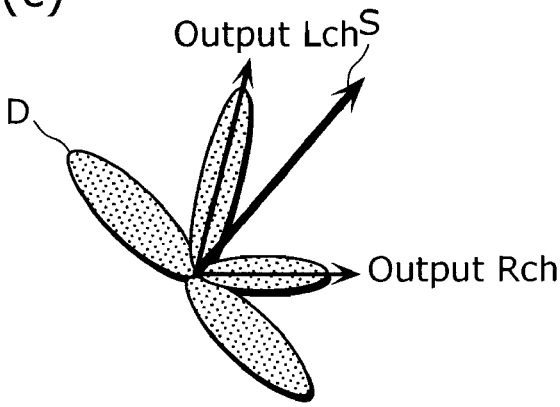
Figure 2:
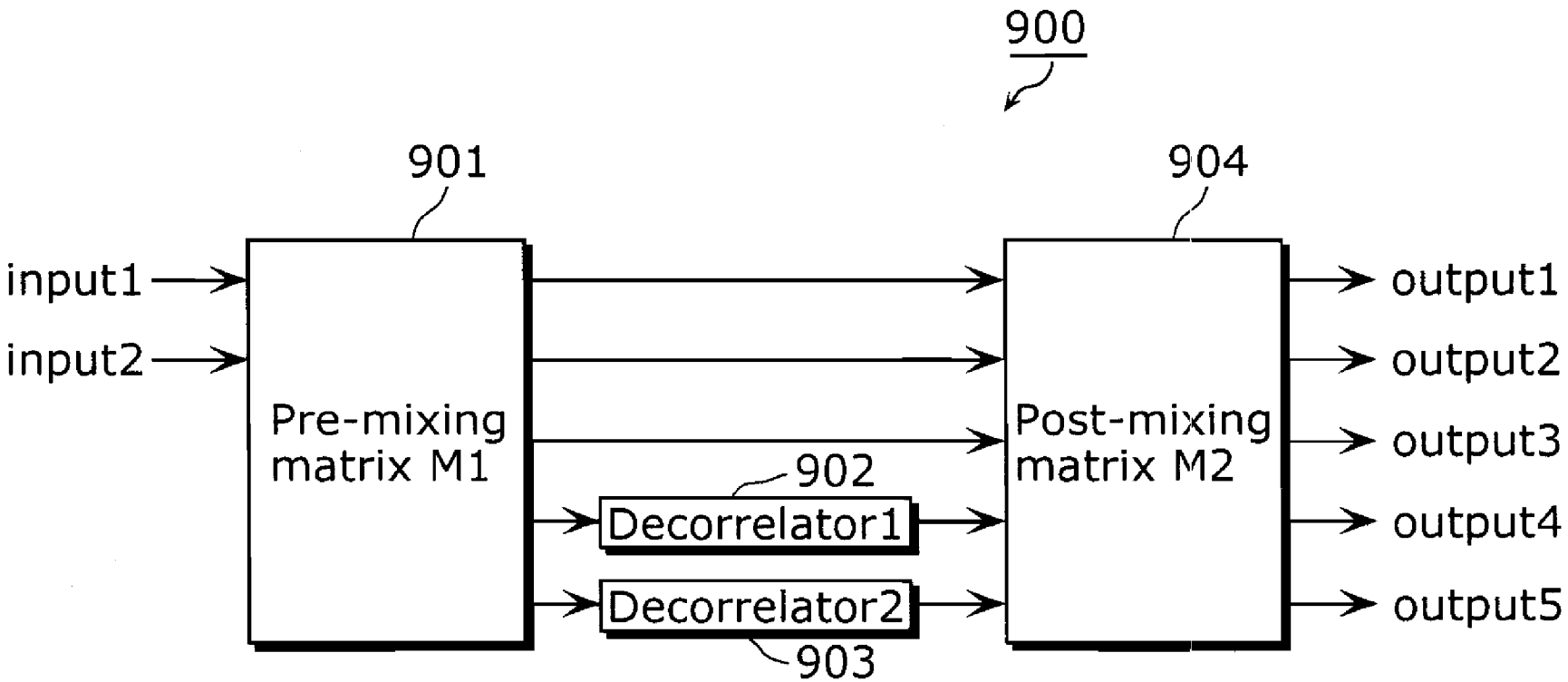
FIG. 2 is a block diagram showing a functional structure of the conventional acoustic signal processing apparatus 900 in the case of RM0.

24 acoustic signal processing apparatus
241 first matrix arithmetic unit
242, 243 decorrelators
244 second matrix arithmetic unit

245 first determinant generation unit
246 second determinant generation unit
247 interpolation unit

DETAILED DESCRIPTION OF THE INVENTION

The following is a description of embodiments of the present invention, with reference to the drawings.

First Embodiment

Figure 4:
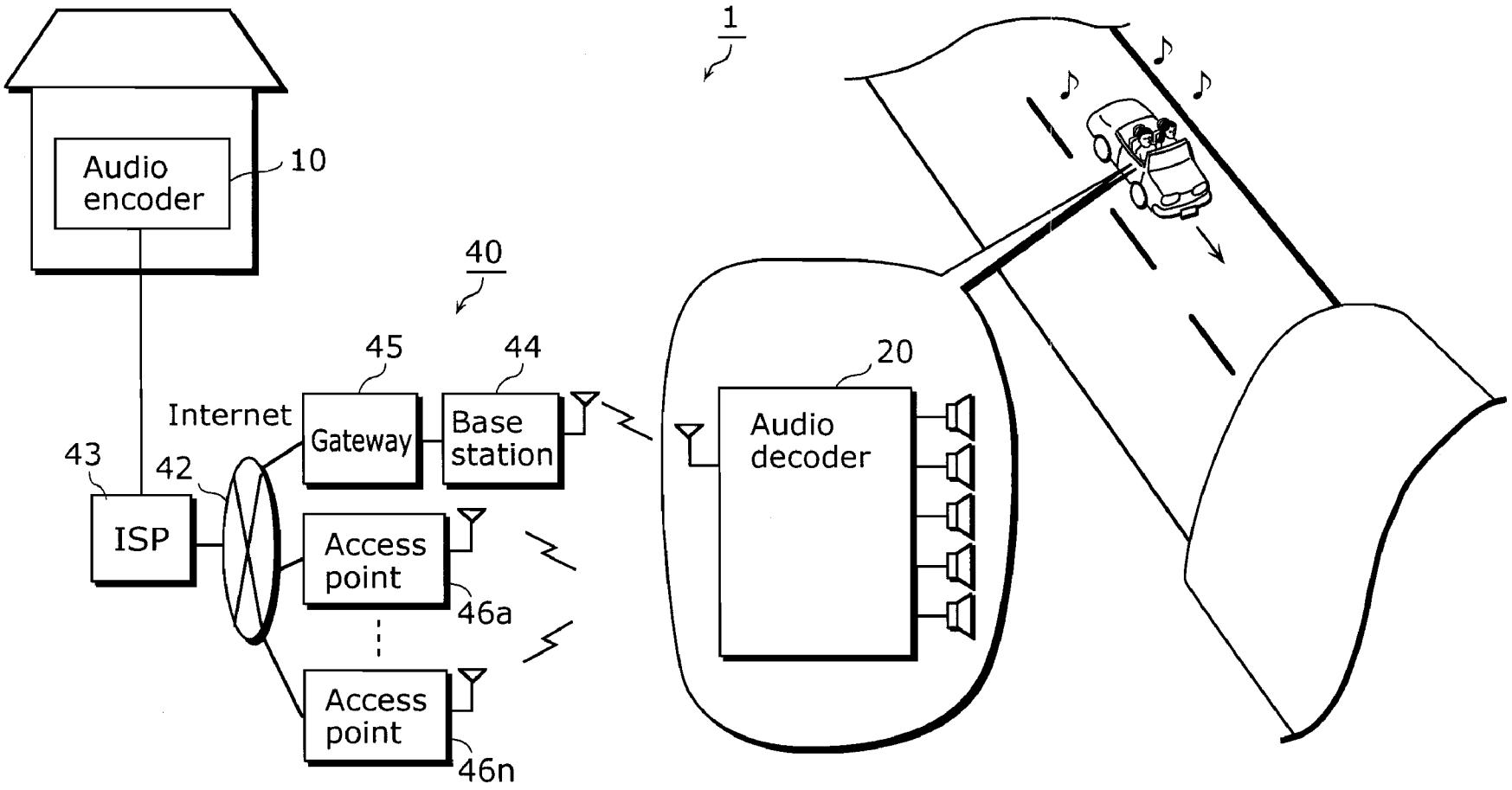
FIG. 4 is a diagram showing an overall structure of an audio content distribution system 1 which uses an acoustic signal processing apparatus of a first embodiment according to the present invention.

FIG. 4 is a diagram showing an overall structure of an audio content distribution system 1 which uses an acoustic signal processing apparatus of the first embodiment according to the present invention.

As shown in FIG. 4, the audio content distribution system 1 includes: an audio encoder 10; an audio decoder 20; and a communication path 40 which connects the audio encoder 10 and the audio decoder 20 for mutual communications. The audio encoder 10 sends audio content via one segment of the communication path 40. While receiving the audio content, the audio decoder 20 performs streaming reproduction at a predetermined bit rate. It should be noted here that an explanation is given in the first embodiment on the assumption that the audio encoder 10 is placed in a broadcast station or the like and the audio decoder 20 is placed in an automobile.

The communication path 40 includes: an Internet 42 as a center; an Internet Service Provider (also referred to as the "ISP" hereafter) 43 which is connected to the Internet 42; a gateway 45 and a base station 44 which build a cellular phone network; and a plurality of access points 46*a* to 46*n* which build a wireless LAN. These access points 46*a* to 46*n* are successively placed along a road so that the communication is available even while the automobile is moving.

The audio encoder 10 is connected to the Internet 42 via the ISP 43. The audio decoder 20 is connected to the Internet 42 via the cellular phone network and the wireless LAN.

Figure 5:
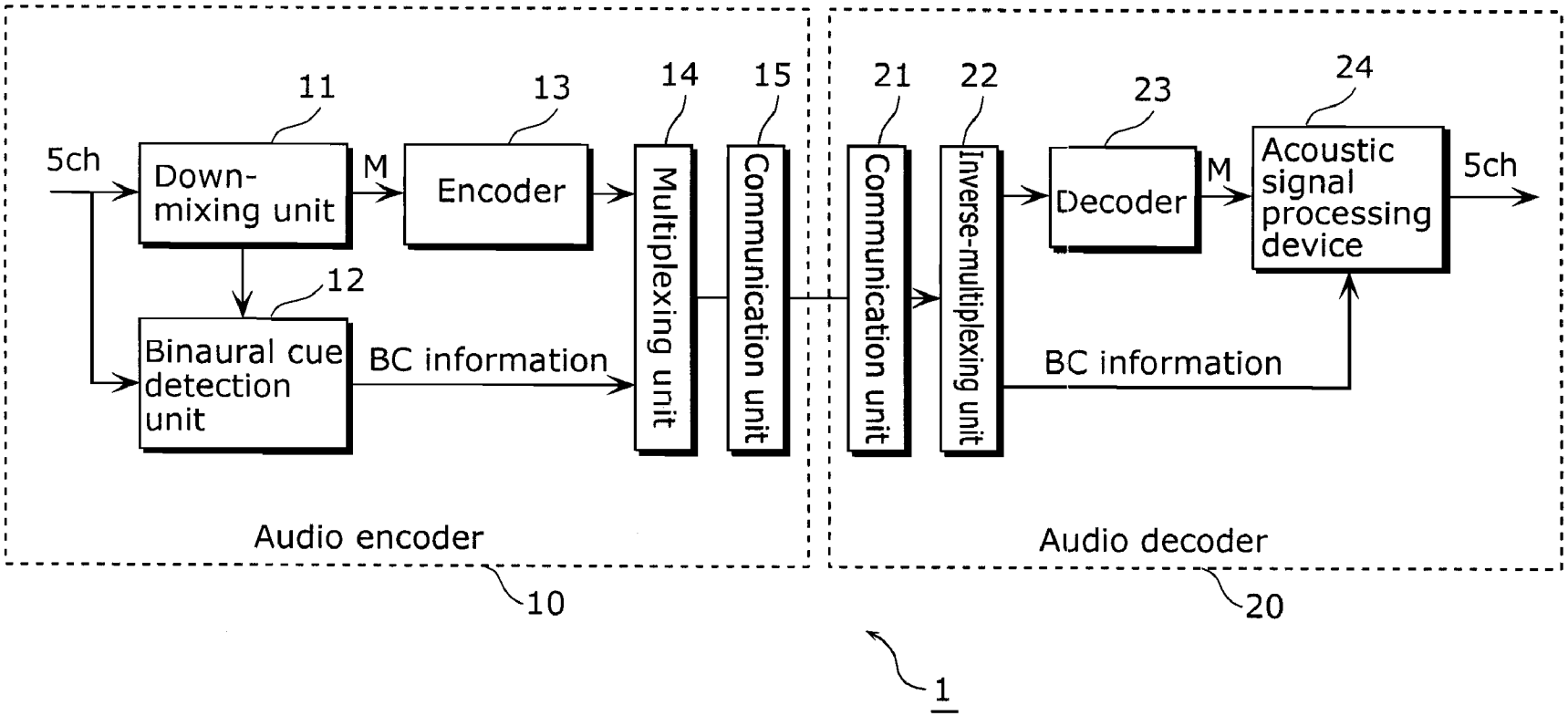
FIG. 5 is a block diagram showing detailed structures of an audio encoder 10 and an audio decoder 20 shown in FIG. 4.

FIG. 5 is a block diagram showing detailed structures of the audio encoder 10 and the audio decoder 20 shown in FIG. 4. Note that the communication path 40 is not shown in FIG. 5.

The audio encoder 10 processes audio signals of a plurality of channels (audio signals of five channels, for example) for each frame representing 1024 samples or 2048 samples, for instance. The audio encoder 10 includes a down-mixing unit 11, a binaural cue detection unit 12, an encoder 13, a multiplexing unit 14, and a communication unit 15 for connecting to the communication path 40.

The down-mixing unit 11 generates down-mixed signals Ms down mixed to two channels, by calculating an average of audio signals of five channels that are expressed spectrally.

The binaural cue detection unit 12 generates BC information (a binaural cue) to convert the down-mixed signals Ms back to the five-channel audio signals, by comparing the five-channel audio signals and the down-mixed signals Ms for each spectral band.

The BC information includes: a CPC which is a value obtained from an acoustic spatial coefficient; correlation information ICC which shows inter-channel coherence/correlation; and a channel level intensity difference CLD which is a value obtained from an acoustic spatial coefficient.

Here, the correlation information ICC shows a similarity among the five audio signals whereas the channel level intensity difference CLD shows a relative intensity among the five-channel audio signals. In general, the channel level intensity difference CLD is information used for controlling balance and localization of sounds, and the correlation information ICC is used for controlling width and diffusion of a sound image. Both of these pieces of information are spatial parameters to help listeners create auditory scenes in their minds.

The audio signals of the five channels expressed spectrally and the down-mixed signals Ms are usually divided into a plurality of groups including "parameter bands". Thus, the BC information is calculated for each parameter band. It should be noted here that the "BC information" and the "spatial parameters" are often used synonymously with each other.

The encoder 13 compresses and encodes the down-mixed signals Ms according to MP3 (MPEG Audio Layer-3), AAC (Advanced Audio Coding), or the like.

The multiplexing unit 14 generates a bitstream by multiplexing the down-mixed signals Ms and quantized BC information, and then outputs the bitstream as the encoded signals described above.

The audio decoder 20 includes: a communication unit 21 for connecting to a communication path 21; an inverse-multiplexing unit 22; a decoder 23; and an acoustic signal processing apparatus 24.

The inverse-multiplexing unit 22 acquires the above bitstream, divides the bitstream into the quantized BC information and the encoded down-mixed signals Ms, and then outputs the resulting BC information and the down-mixed signals Ms. Note that the inverse-multiplexing unit 22 performs inverse quantization on the quantized BC information, and then outputs the resulting BC information.

The decoder 23 decodes the encoded down-mixed signals Ms and outputs the decoded down-mixed signals Ms to the acoustic signal processing apparatus 24.

The acoustic signal processing apparatus 24 acquires the down-mixed signals Ms outputted from the decoder 23 and the BC information outputted from the inverse-multiplexing unit 22. Then, the acoustic signal processing apparatus 24 reconstructs the five audio signals from the down-mixed signals Ms, using the BC information.

It should be noted here that although the audio content distribution system has been explained with an example where the audio signals of five channels are encoded and then decoded, the audio content distribution system can also encode and decode audio signals of more than two channels (for example, audio signals of six channels making up a 5.1-channel sound source).

Note that, in order to show how to improve the technology disclosed by RM0, the first embodiment is contrasted with the RM0 technology whereby the two-channel input signals are converted into the five-channel output signals as explained in the above Background Art. Although the present embodiment is described for the case where inputs are two channels and outputs are five channels, this is just one example. Thus, it is obvious that the outputs may be 5.1 channels or the like.

Figure 6:
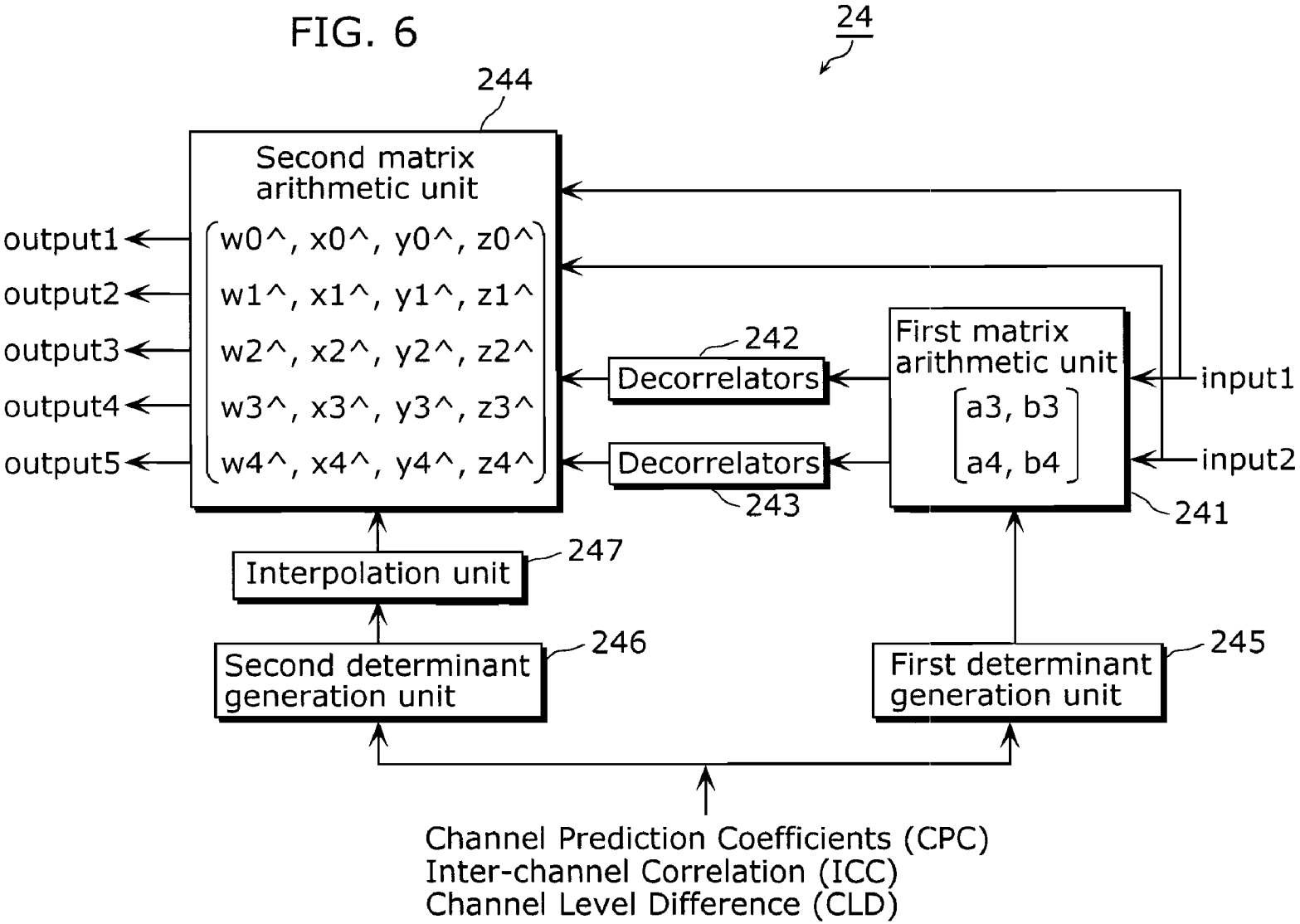
FIG. 6 is a block diagram showing a functional structure of an acoustic signal processing apparatus 24 shown in FIG. 5.

FIG. 6 is a block diagram showing a functional structure of the acoustic signal processing apparatus 24 shown in FIG. 5.

As shown in FIG. 6, the acoustic signal processing apparatus 24 includes: a first matrix arithmetic unit 241 for performing arithmetic on a two-row*two-column matrix; two decorrelators 242 and 243; a second matrix arithmetic unit 244 for performing arithmetic on a five-row*four-column matrix; a first determinant generation unit 245 for calculating each element of a first determinant of the first matrix arithmetic unit 241, on the basis of the BC information transmitted for each of frames separated by a predetermined time interval; a second determinant generation unit 246 for calculating each element of a second determinant of the second matrix arithmetic unit 244, on the basis of the BC information transmitted for each of the frames separated by the predetermined time interval; and an interpolation unit 247 for smoothing out the values generated by the second determinant generation unit 246 by performing interpolation between the frames.

The first matrix arithmetic unit 241, the first and second decorrelators 242 and 243, the second matrix arithmetic unit 244, the first determinant generation unit 245, the second determinant generation unit 246, and the interpolation unit 247 as described above are realized by a program previously stored in a ROM, a digital signal processor (DSP) executing the program, a memory providing a work area for execution of the program, and so forth.

The following is an explanation of an operation performed by the acoustic signal processing apparatus 24 structured as described above. Before the explanation, a reason is given as to why the determinant shown in FIG. 3 according to the conventional technology can be changed to the determinant shown in the structure of FIG. 6, with reference to FIGS. 7 to 11.

Figure 3:
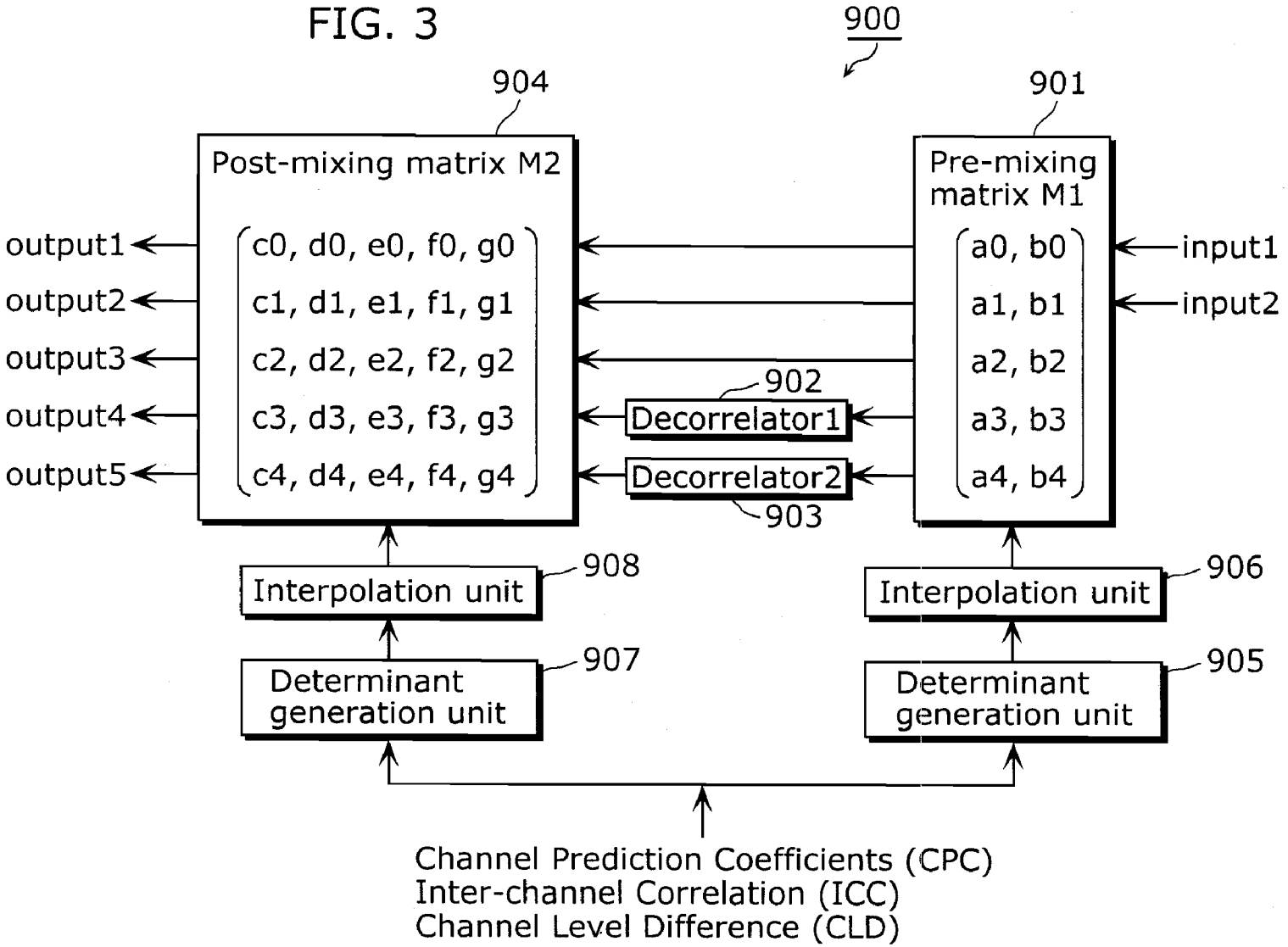
FIG. 3 is a block diagram showing a more detailed functional structure of the acoustic signal processing apparatus 900.
Figure 7:
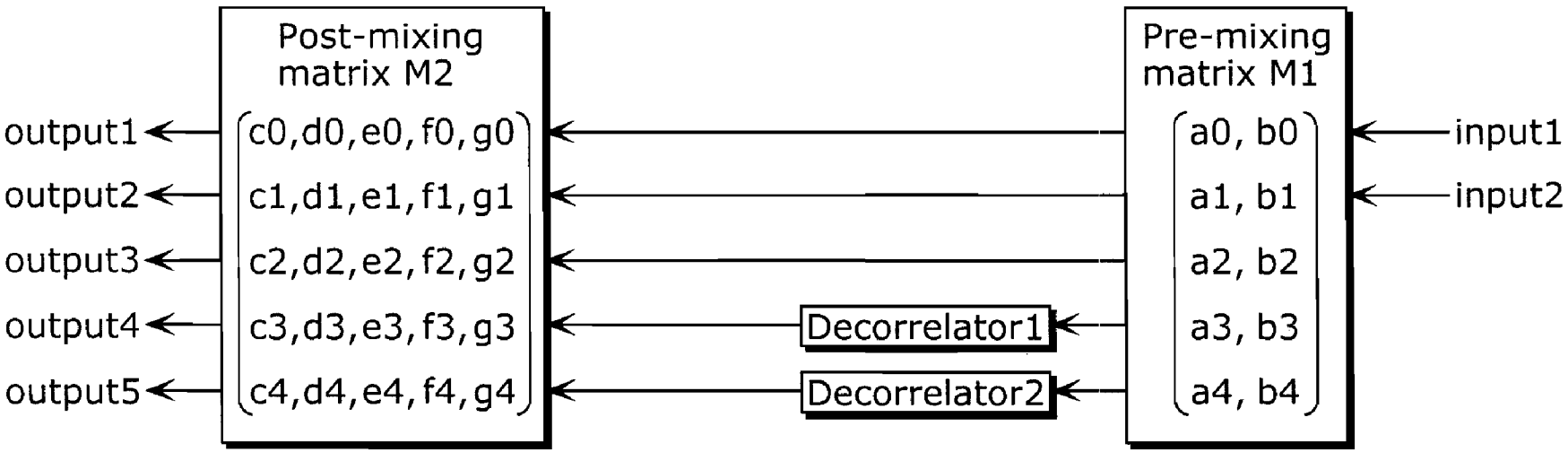
FIG. 7 is a diagram showing a main flow of the signal processing according to the conventional technology.

FIG. 7 is a diagram of part showing a main signal flow that is extracted from FIG. 3. Thus, the signal flow is the same as explained in the above Background Art, that is, the two-channel signals are inputted from the right-hand side and then the five-channel signals are outputted eventually.

Figure 8:
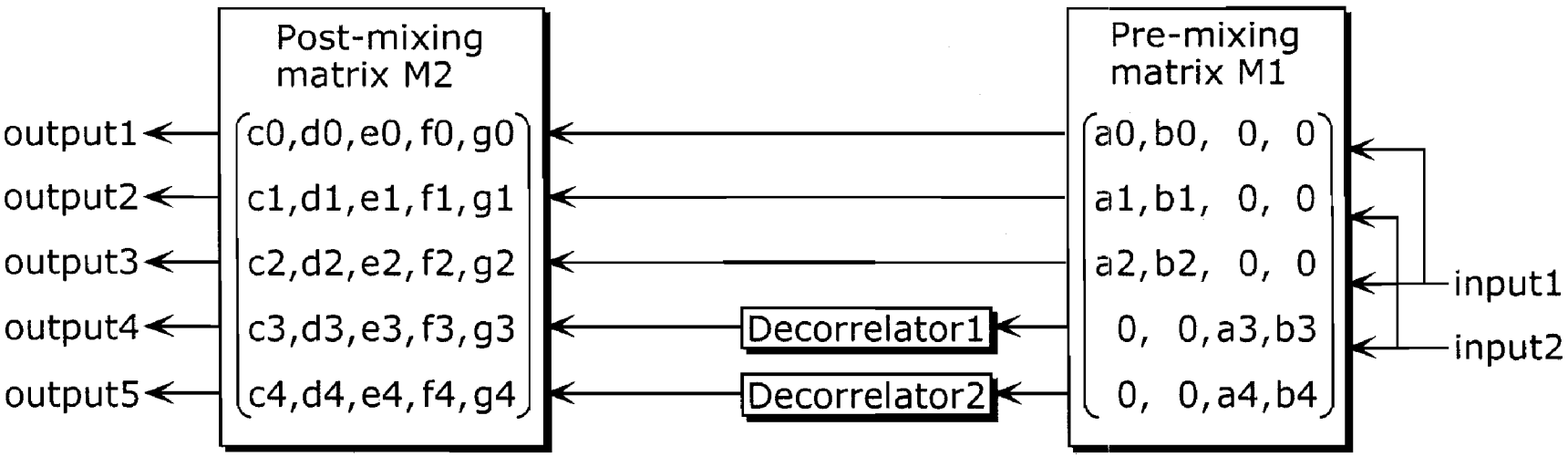
FIG. 8 is a diagram showing that a matrix arithmetic expression of a pre-mixing matrix M1 shown in FIG. 7 is expanded by the insertion of "0".

FIG. 8 is a diagram showing that the matrix arithmetic expression of the pre-mixing matrix M1 shown in FIG. 7 is expanded by the insertion of "0".

With this expansion of the determinant, the input signals of original two channels are respectively copied so as to be expanded to four signals. However, as apparent from the determinant shown on the right-hand side, the significance of the signal processing is mathematically exactly the same as shown in FIG. 7.

Figure 9:
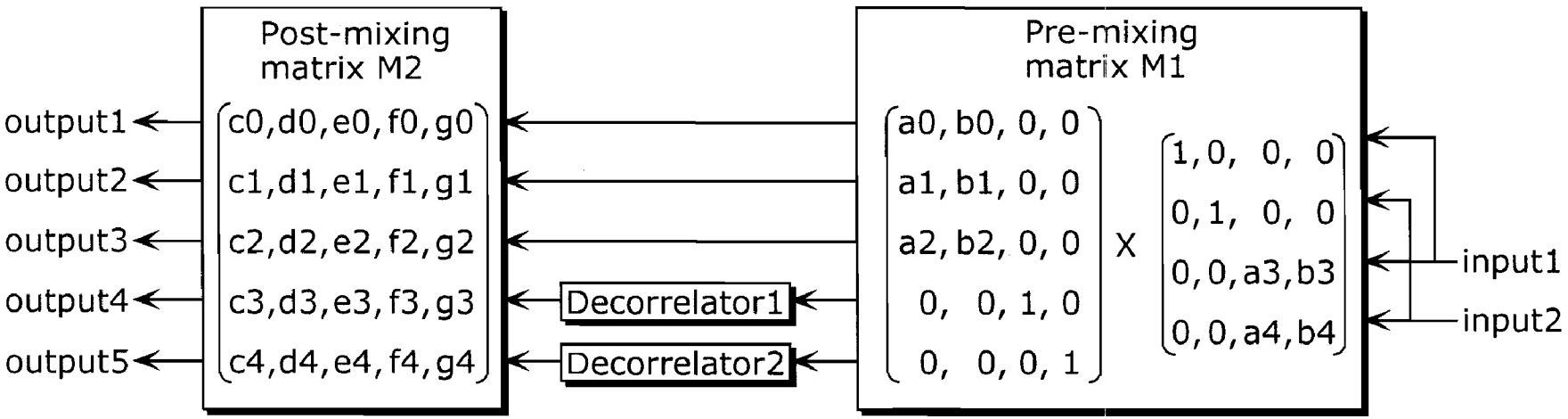
FIG. 9 is a diagram showing that the expanded determinant shown in FIG. 8 is divided into two determinants by the insertion of "1".

FIG. 9 is a diagram showing that the expanded determinant shown in FIG. 8 is divided into two determinants by the insertion of "1".

Here, the determinant is simply divided into two. Accordingly, as apparent from the determinants shown on the right-hand side, it is mathematically exactly the same as shown in FIG. 7.

Figure 10:
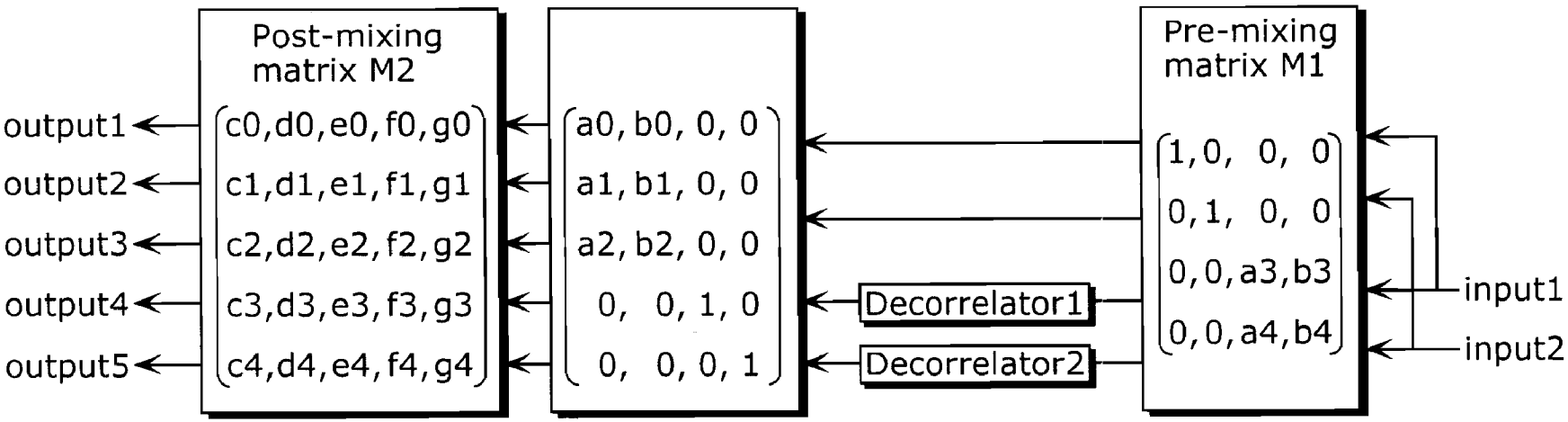
FIG. 10 is a diagram showing that a sequence of the signal processing is changed with respect to the sequence shown in FIG. 9.

FIG. 10 is a diagram showing that a sequence of the signal processing is changed with respect to the sequence shown in FIG. 9.

To be more specific, the process for the left-side determinant out of the divided determinants and the process by the decorrelators in FIG. 9 are interchanged.

Figure 11:
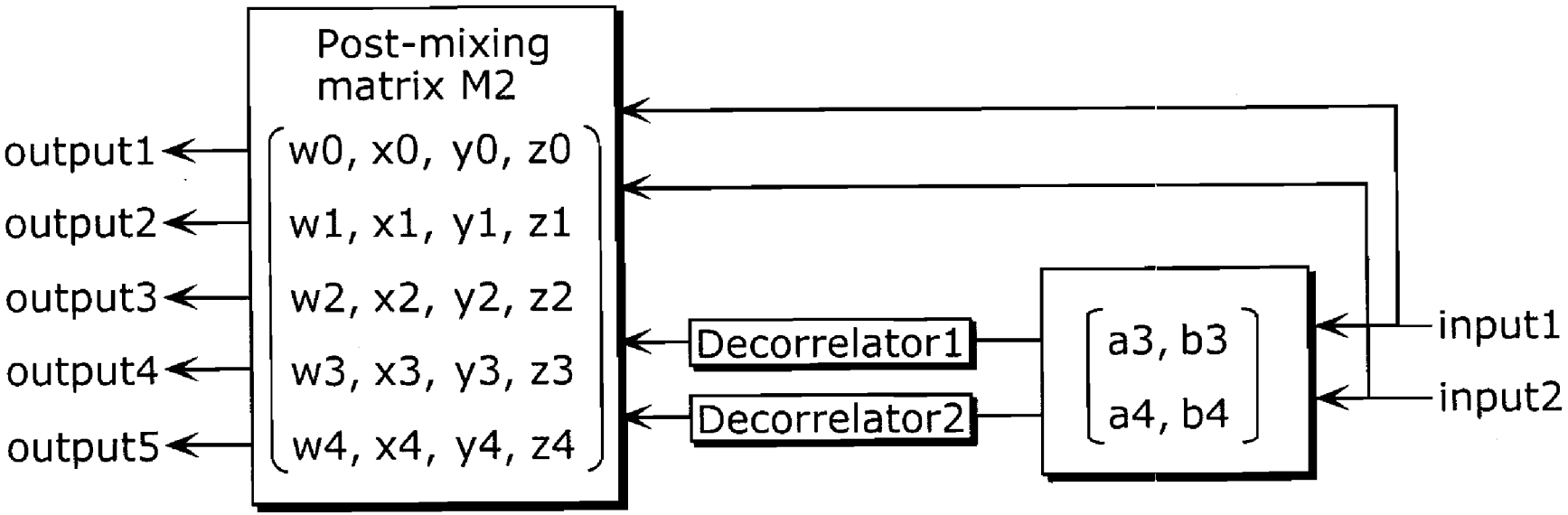
FIG. 11 is a diagram showing that what is shown in FIG. 10 is rationalized.
Figure 12:
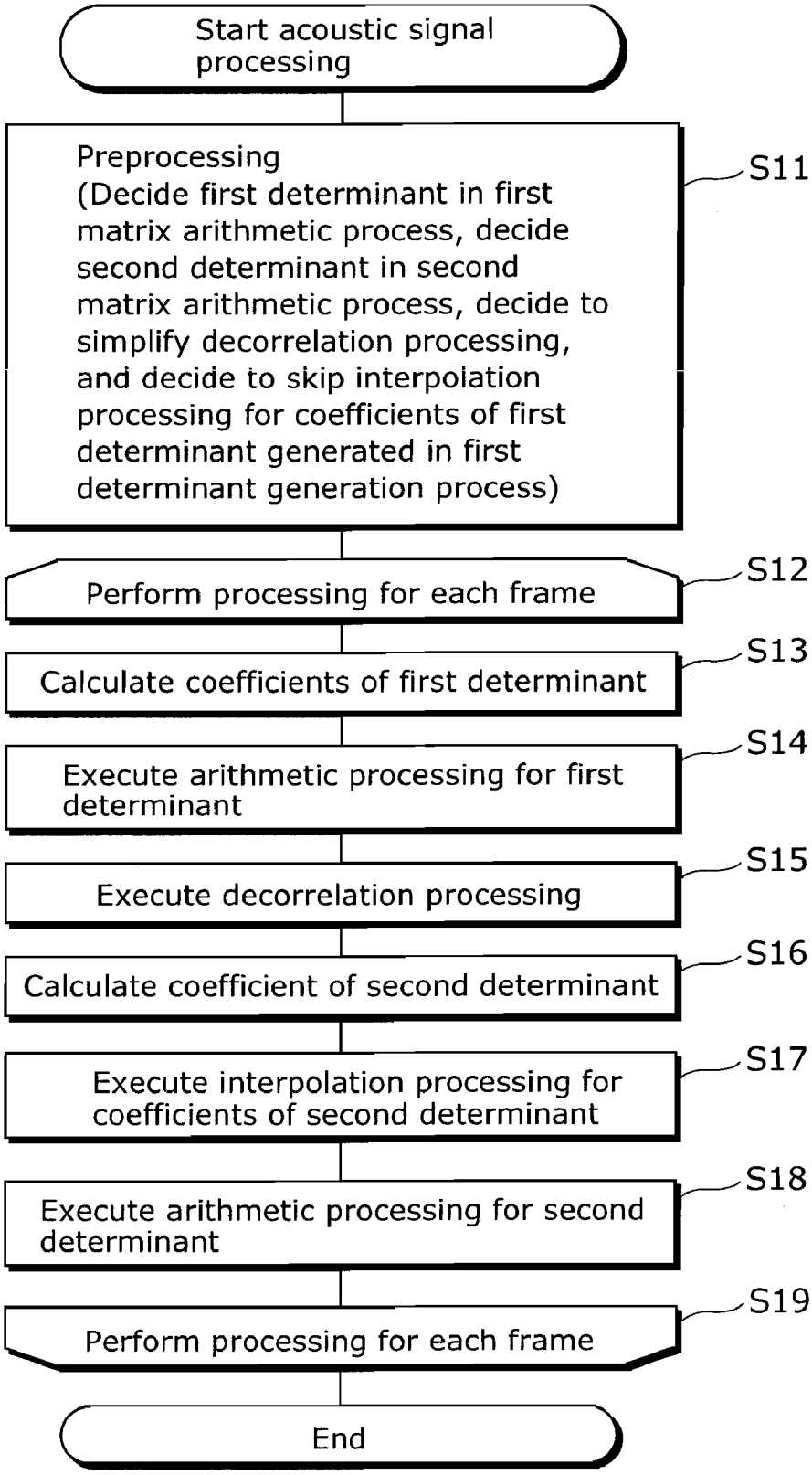
FIG. 12 is a flowchart showing an operation of processing performed by units of the acoustic signal processing apparatus 24.
Figure 13A:
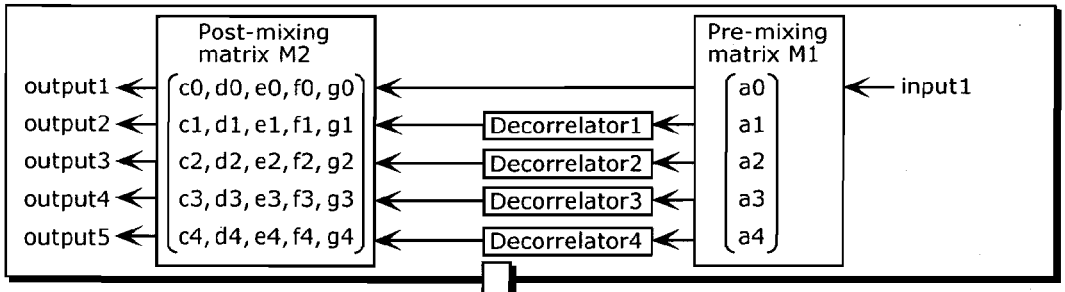
FIG. 13 is a diagram showing an idea of applying the technology of the present invention, for the case where a one-channel signal is converted to five-channel signals by an acoustic signal processing apparatus of a second embodiment according to the present invention.
Figure 13B:
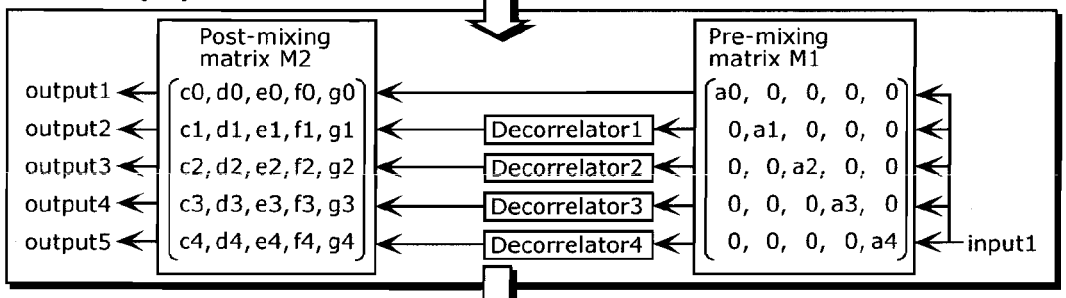
Figure 13C:
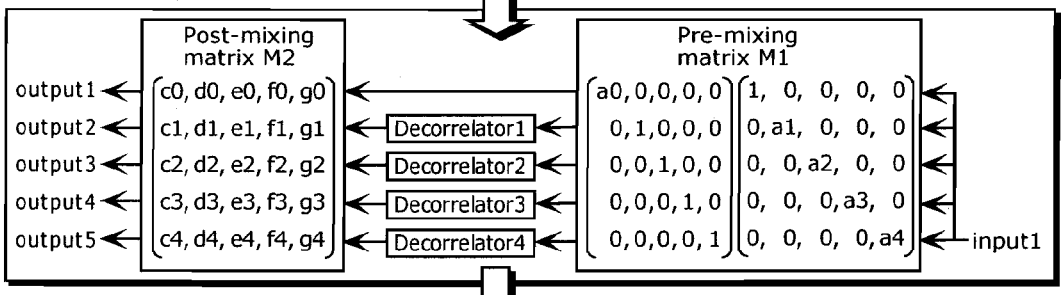
Figure 13D:
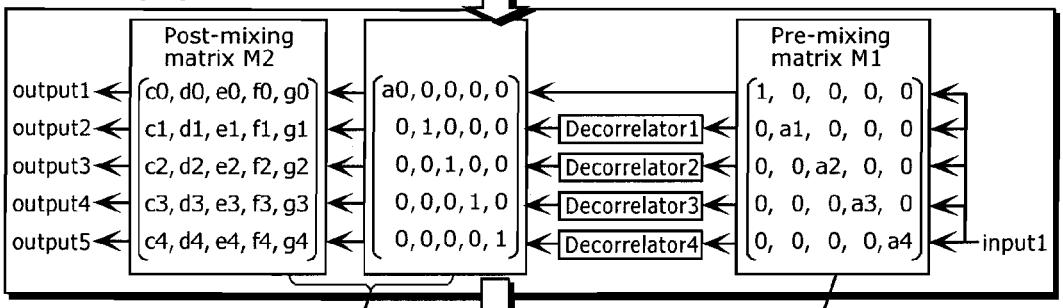
Figure 13E:
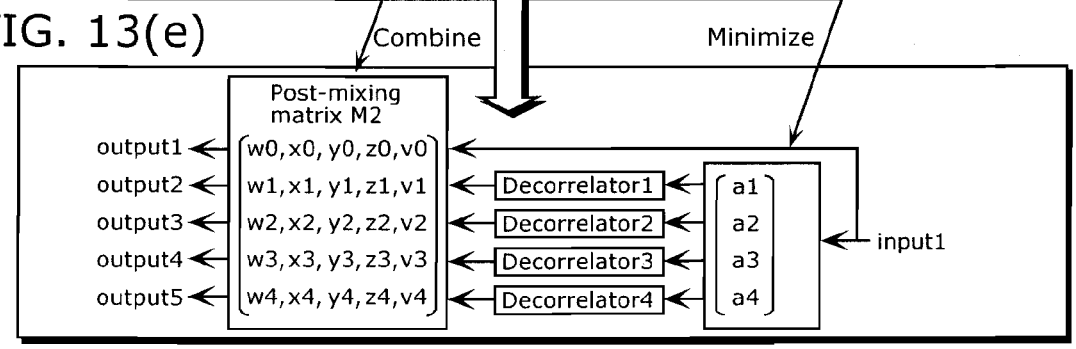

FIG. 11 is a diagram showing that what is shown in FIG. 10 is rationalized.

To be more specific, the diagram shows that: the two determinants shown on the left-hand side in FIG. 10 are combined into one by previously performing matrix arithmetic on the determinants; and the size of the matrix shown on the right-hand side in FIG. 10 is reduced by deleting the elements whose coefficients are "1" from the determinant. For example, an element w0 in the first row and the first column of the left-side determinant of FIG. 11 can be calculated as follows, according to the usual manner of matrix arithmetic:

$$w0=c0*a0+d0*a1+e0*a2+f0*0+g0*0$$

The other elements are calculated in the same way according to the usual manner of matrix arithmetic.

In this way, as shown in FIGS. 7 to 11, the flow of the signal processing in the case of RM0 can be changed to the flow of the signal processing of the present invention shown in FIG. 6, by dividing the determinant, interchanging the sequence of the processes, and combining the determinants.

Accordingly, while the amount of calculation is reduced, the acoustic signals of NO channels with a high sound quality can be outputted without signal crosstalk into the other channels.

Next, the following is an explanation as to an operation performed by the units of the acoustic signal processing apparatus 24 structured as shown in FIG. 6.

When converting the down-mixed signals of two channels into the signals of five channels, the DSP first executes preprocessing (S11).

This preprocessing includes making a decision so that the first determinant of the first matrix arithmetic unit 241 is formed only by minimum-unit coefficients that are related to gain control and are necessary to the first and second decorrelators 242 and 243, these coefficients being obtained by separating coefficients that are related to the gain control and are unnecessary to the first and second decorrelators 242 and 243, from the coefficients related to the gain control. Also, the preprocessing includes making a decision so that the second determinant of the second matrix arithmetic unit 244 is formed by coefficients which are obtained by combining: the coefficients that are related to the gain control and are unnecessary to the first and second decorrelators 242 and 243; and coefficients related to phase control. Moreover, the preprocessing includes making a decision to simplify the processing performed by the first and second decorrelators 242 and 243 (a 90-degree phase rotation, for example). Furthermore, the preprocessing includes making a decision to skip the interpolation processing for the coefficients generated by the first determinant generation unit 245.

After the preprocessing is finished, the DSP repeatedly executes the processing for each frame (S12 to S19).

In this processing performed for each frame, the DSP first causes the first determinant generation unit 245 to calculate each element of the first determinant of the first matrix arithmetic unit 241 from the inter-channel coherence information, the channel level difference, and the channel prediction coefficient transmitted for each of the frames separated by the predetermined time interval (S13).

To be more specific, the elements a3, b3, a4, and b4 of the determinant of the first matrix arithmetic unit 241 are calculated. Here, the values of a3, b3, a4, and b4 have the same significance as the values of a3, b3, a4, and b4 of FIG. 3. For this reason, the calculation method can be the same as the method defined by RM0. More specifically, using characters employed by RM0, the determinant shown on the right-hand side of FIG. 6 is expressed as the following Equation (3) which is a determinant of a two-row*two-column matrix.

[Equation 3]

$$R_1^{l,m} = \gamma^{l,m}\frac{1}{3}\begin{bmatrix} \alpha^{l,m}+2 & \beta^{l,m}-1 \\ \alpha^{l,m}-1 & \beta^{l,m}+2 \end{bmatrix} \tag{3}$$

It should be obvious that Equation (3) is an example where so-called Residual Coding is not performed. When Residual Coding is performed, the determinant would be the following Equation (4) which is a determinant with a two-row*three-column matrix.

[Equation 4]

$$R_1^{l,m} = \gamma^{l,m}\frac{1}{3}\begin{bmatrix} \alpha^{l,m}+2 & \beta^{l,m}-1 & 1 \\ \alpha^{l,m}-1 & \beta^{l,m}+2 & 1 \end{bmatrix} \quad (4)$$

Note that, however, the values of a3, b3, a4, and b4 in FIG. 3 are obtained after the processing of the interpolation unit 247 and are thus different from the values of the elements a3, b3, a4, and b4 of the determinant of the first matrix arithmetic unit 241 in FIG. 6 that are obtained before the processing of the interpolation unit 247. In either case, the calculation method can be the same as the method defined by RM0.

Next, an explanation is given as to a main signal flow with reference to FIG. 6.

For an input 1 and an input 2, the first matrix arithmetic unit 241 performs matrix arithmetic for each element. More specifically, the DSP executes the arithmetic processing for the first determinant of the first matrix arithmetic unit 241 (S14). The signals generated in this way are processed by the first and second decorrelators 242 and 243. To be more specific, the DSP executes the decorrelation processing in the first and second decorrelators 242 and 243 (S15).

These first and second decorrelators 242 and 243 perform processing to generate signals which are incoherent with the input signals in terms of temporal characteristics while maintaining frequency characteristics of the input signals. Although a lattice all-pass filter is used as a method in the case of RM0, a simplified method whereby the phase of the input signal is rotated 90 degrees can be employed. This is because, when the phase of the input signal is rotated 90 degrees, the frequency characteristics of the signal are completely maintained and a signal which is completely mathematically-incoherent can be generated. In addition, when there are a plurality of input signals, the processing can be realized by exchanging a real number term and an imaginary number term and then inverting one of the codes. On account of this, the structures of the first and second decorrelators 242 and 243 can be simplified and the amount of calculation can be thus extremely small.

After the completion of the decorrelation processing, the DSP causes the second determinant generation unit 246 to calculate values as the basis of the elements in the determinant of the second matrix arithmetic unit 244, from the inter-channel coherence information and the channel level difference transmitted for each of the frames separated by the predetermined time interval (S16).

To be more specific, the second determinant generation unit 246 acquires two determinants shown on the left-hand side in FIG. 10 and additionally executes a process to combine these two determinants. Here, the values of a0, b0, a1, b1, a2, and b2 shown in FIG. 10 have the same significance as the values of a0, b0, a1, b1, a2, and b2 shown in FIG. 3. On account of this, the calculation method can be the same as the method defined by RM0.

More specifically, when using characters employed by RM0, the right-hand determinant out of the two determinants shown on the left-hand side in FIG. 10 is expressed as the following Equation (5) which is a determinant of a five-row*four-column matrix.

[Equation 5]

$$R_1^{l,m} = \gamma^{l,m}\frac{1}{3}\begin{bmatrix} \alpha^{l,m}+2 & \beta^{l,m}-1 & 0 & 0 \\ \alpha^{l,m}-1 & \beta^{l,m}+2 & 0 & 0 \\ (1-\alpha^{l,m})\sqrt{2} & (1-\beta^{l,m})\sqrt{2} & 0 & 0 \\ 0 & 0 & 1 & 0 \\ 0 & 0 & 0 & 1 \end{bmatrix} \quad (5)$$

It is obvious that Equation (5) is an example where: so-called Residual Coding is not performed; so-called Ttt Decorrelator processing is not performed; and an LFE channel is omitted. When these are all performed, the determinant would be the following Equation (6).

[Equation 6]

$$R_1^{l,m} = \gamma^{l,m}\frac{1}{3}\begin{bmatrix} \alpha^{l,m}+2 & \beta^{l,m}-1 & 1 & -0 & 0 & 0 \\ \alpha^{l,m}-1 & \beta^{l,m}+2 & 1 & 0 & 0 & 0 \\ (1-\alpha^{l,m})\sqrt{2} & (1-\beta^{l,m})\sqrt{2} & -\sqrt{2} & 0 & 0 & 0 \\ 0 & 0 & 0 & 1 & 0 & 0 \\ 0 & 0 & 0 & 0 & 1 & 0 \\ 0 & 0 & 0 & -0 & 0 & 1 \end{bmatrix} \quad (6)$$

Note that, however, although the values of a0, b0, a1, b1, a2, and b2 in FIG. 3 are obtained after the processing of the interpolation unit 247, the values of a0, b0, a1, b1, a2, and b2 used here are obtained before the processing of the interpolation unit 247.

Moreover, the values of c0 to c4, d0 to d4, e0 to e4, f0 to f4, and g0 to g4 shown in FIG. 10 have the same significance as the values of c0 to c4, d0 to d4, e0 to e4, f0 to f4, and g0 to g4 shown in FIG. 3. On account of this, the calculation method can be the same as the method defined by RM0. Note that, however, although the values of c0 to c4, d0 to d4, e0 to e4, f0 to f4, and g0 to g4 in FIG. 3 are obtained after the processing of the interpolation unit 247, the values of c0 to c4, d0 to d4, e0 to e4, f0 to f4, and g0 to g4 used here are obtained before the processing of the interpolation unit 247. According to the usual manner of matrix arithmetic, the values of a0, b0, a1, b1, a2, b2, and c0 to c4, d0 to d4, e0 to e4, f0 to f4, and g0 to g4 calculated in this way are combined into one determinant where the values are shown as w0 to w4, x0 to x4, y0 to y4, and z0 to z4 in FIG. 11.

Next, the DSP smoothes out the values of w0 to w4, x0 to x4, y0 to y4, and z0 to z4 in order to prevent the elements of the determinant from abruptly changing between the frames. For doing so, the DSP has the interpolation unit 247 interpolate between the above-mentioned w0 to w4, x0 to x4, y0 to y4, and z0 to z4 generated by the second determinant generation unit 246 and these values generated in the immediately preceding processed frame (S17). The values obtained according to this manner are shown as w0ˆ to w4ˆ, x0ˆ to x4ˆ, y0ˆ to y4ˆ, and z0ˆ to z4ˆ in the second matrix arithmetic 244 of FIG. 6

Here, a symbol "ˆ" is assigned to each element to indicate that the current value is obtained after the interpolation processing. The way how the signal processing is altered was shown earlier with reference to FIGS. 7 to 11, and "ˆ" is not assigned to the final elements of the left-hand determinant in FIG. 11 because the drawing only aims to mathematically show how the signal processing is altered. On the other hand, the elements of the left-hand determinant in FIG. 6 are obtained after the interpolation processing and, for this reason, the symbol "^" is assigned to make a clear distinction.

It should be noted that the interpolation unit 247 may be removed for the purpose of reducing the amount of calculation. Moreover, although the coefficients of the determinant generated by the first determinant generation unit 245 are not processed by the interpolation unit 247 in FIG. 6, these coefficients may be smoothed out in the interpolation processing.

However, in view of influence on the sound quality, the coefficients of the determinant generated by the first matrix arithmetic 245 do not have to be smoothed out as shown in FIG. 6 since there is little influence on the sound quality.

The reason is explained. The outputs of the first matrix arithmetic unit 241 are all inputted to the immediately succeeding first and second decorrelators 242 and 243. The first and second decorrelators 242 and 243 perform the processing whereby reverberation components are given to the sound according to RM0. Thus, even when the determinant abruptly changes because the smoothing is not performed, the effect by the first and second decorrelators 242 and 243 to blur the sound can weaken a sense of discontinuity at changing points of the determinant.

In this way, the signals of four channels in total including the two-channel signals converted by the first and second decorrelators 242 and 243 and the signals of the input 1 and the input 2 are processed by the second matrix arithmetic 244, so that the five-channel signals are generated as the outputs. To be more specific, the DSP executes the arithmetic processing using the second determinant of the second matrix arithmetic unit 244 (S18). Here, take notice that each element of the determinant of the second matrix arithmetic unit 244 is sequentially interpolated.

For example, in the case where one frame time has a time length lasting for 32 units of time, the elements of the determinant of the first matrix arithmetic 241 respectively maintain the same values during the 32 units of time whereas the elements of the determinant of the second matrix arithmetic 244 are sequentially changed for each unit of time. For example, take the value of w0 of the first row and the first column in the determinant of the second matrix arithmetic 244. When the value of w0 in the current frame generated by the second determinant generation unit 246 is w0($t$) and the value of w0 in the preceding frame generated by the second determinant generation unit 246 is w0($t-1$), the interpolation unit 247 interpolates between w0($t-1$) and w0($t$) for each unit of time so that the value smoothly shifts from w0($t-1$) to w0($t$).

As described so far, the first embodiment includes: the first matrix arithmetic 241 for performing matrix arithmetic on N rows; an NI number of the first and second decorrelators 242 and 243; and the second matrix arithmetic 244 for performing matrix arithmetic on NO rows. Thus, the amount of calculation can be reduced by having: NI-channel signals as the inputs of the first matrix arithmetic unit 241; the output signals of the first matrix arithmetic unit 241 as the inputs of the first and second decorrelators 242 and 243; and the input signals of the first matrix arithmetic unit 241 and the output signals of the first and second decorrelators 242 and 243 as the inputs of the second matrix arithmetic unit 244.

Suppose a case of RM0 where the pre-mixing matrix M1 performs matrix arithmetic on a five-row*two-column matrix and the post-mixing matrix M2 performs matrix arithmetic on a five-row*five-column matrix, for example. When applying the technology of the present invention to this case, the first matrix arithmetic is to be performed on a two-row*two-column matrix and the second matrix arithmetic is to be performed on a five-row*four-column matrix. In this way, the amount of calculation can be reduced.

Moreover, the present embodiment includes the determinant generation unit 245 for generating each coefficient of the determinants of the first matrix arithmetic unit 241 and the second matrix arithmetic unit 244 on the basis of the parameters updated for each of the frames separated by the predetermined time interval. The coefficients of the determinant of the first matrix arithmetic 241 are constant in each frame whereas the coefficients of the determinant of the second matrix arithmetic 244 are calculated by sequentially performing interpolation using the parameters of the immediately preceding frame or the coefficients of the determinant of the immediately preceding frame. Thus, the interpolation processing for each element of the determinant can be performed only for the second matrix arithmetic expression and, as a result, the amount of calculation can be reduced.

Also, the first and second decorrelators 242 and 243 may rotate the phases of the input signals by 90 degrees as their processing to perform. Then, the structures of the first and second decorrelators 242 and 243 can be remarkably simplified.

In the first embodiment, the process to calculate the coefficients of the second determinant (S16) and the process to execute the interpolation processing for the coefficients of the second determinant (S17) are performed after the decorrelation processing. However, these processes may be executed between Step S13 and Step S14. This can separate the process for calculating the coefficients and the main process for converting the signals to the five-channel acoustic signals.

Moreover, the first embodiment describes the processing flow in the case of generating the multichannel outputs corresponding to the two-channel inputs. However, the present invention can be applied to the case of generating multichannel outputs corresponding to a one-channel input.

Second Embodiment

For example, an explanation is given as to a case where the number of output channels is five corresponding to an input of one channel, with reference to FIG. 13.

The purpose of the present invention is to make the amount of calculation required for the first matrix arithmetic unit 241 smaller than the amount of calculation required for the pre-mixing matrix M1 disclosed in RM0, by equalizing the number of rows in the determinant of the first matrix arithmetic unit 241 with the number of decorrelators.

The top drawing of FIG. 13, which is illustrated as FIG. 13($a$), shows a signal flow of generating the multichannel outputs corresponding to the one-channel input in the case of RM0. In the second and third drawings from the top, which are illustrated as FIG. 13($b$) and FIG. 13($c$), what is shown in FIG. 13($a$) is mathematically expanded and divided. The concepts were described above with reference to FIGS. 8 and 9.

In the fourth drawing from the top, which is illustrated as FIG. 13($d$), the processes performed by the decorrelators and the process for matrix arithmetic are interchanged. The concept was described above with reference to FIG. 10.

In the bottom drawing, which is illustrated as FIG. 13($e$), the amount of calculation is reduced in comparison with the fourth drawing from the top, by combining the left-hand two determinants in advance and by minimizing (optimizing) the right-hand determinant.

As a result, the determinant of the first matrix arithmetic unit 241 becomes a determinant of a four-row*one-column matrix, and the number of rows is equal to the number of decorrelators. Accordingly, the amount of calculation can be reduced.

Moreover, the outputs of the first matrix arithmetic unit 241 are all inputted to the decorrelators, which add the reverberation components. On this account, the abrupt variations in the elements of the determinant of the first matrix arithmetic unit 241 between the frames are never a problem acoustically. In addition, there is an advantage that the smoothing processing by the interpolation unit is not necessary to the elements of the first determinant.

In the present example, the number of channels as outputs is five. However, it should be obvious that the number of channels may be six in consideration of an LFE channel. In this case, the number of rows in the left-hand determinant is six.

INDUSTRIAL APPLICABILITY

The acoustic signal processing apparatus according to the present invention can perform the processing of decoding the down-mixed signals back to the original multichannel signals with the small amount of calculation. On account of this, the present invention can be applied to low bit-rate music broadcast service and low bit-rate music distribution service, and to receiving apparatuses for receiving such service, for example.

The invention claimed is:

1. An acoustic signal processing apparatus which converts down-mixed acoustic signals of NI channels to acoustic signals of NO channels, where NO>NI, using spatial information parameters updated for each of a plurality of frames separated by a predetermined time interval, said acoustic signal processing apparatus comprising:

a processor;

a first matrix arithmetic unit operable to perform, using said processor, matrix arithmetic for the down-mixed acoustic signals of the NI channels;

K decorrelation units operable to, with respect to output signals of said first matrix arithmetic unit, generate signals which are incoherent, in terms of time characteristics, with the signals obtained after the matrix arithmetic performed by said first matrix arithmetic unit, while maintaining frequency characteristics of the signals obtained after the matrix arithmetic performed by said first matrix arithmetic unit;

a second matrix arithmetic unit operable to (i) perform matrix arithmetic for output signals of said K decorrelation units and for the down-mixed acoustic signals of the NI-channels for which the matrix arithmetic has not been performed by said first matrix arithmetic unit and which have not been decorrelated by said K decorrelation units, and (ii) to output the acoustic signals of the NO channels; and a determinant generation unit operable to generate matrix coefficients of said first matrix arithmetic unit and matrix coefficients of said second matrix arithmetic unit, using the spatial information parameters, wherein said determinant generation unit is operable to generate a determinant for each of the plurality of frames so that (i) a first determinant of said first matrix arithmetic unit has K rows and NI columns and (ii) a second determinant of said second matrix arithmetic unit has NO rows and (NI+K) columns, wherein the first determinant with K rows and NI columns of said first matrix arithmetic unit is formed only by minimum-unit coefficients that are related to gain control and are necessary for said K decorrelation units, the minimum-unit coefficients being obtained by separating (i) coefficients that are related to the gain control and are necessary for said K decorrelation units from (ii) coefficients related to the gain control, and wherein the second determinant with NO rows and (NI+K) columns of said second matrix arithmetic unit is formed by coefficients which are obtained by combining (i) coefficients that are related to the gain control and are unnecessary for said K decorrelation units and (ii) coefficients related to phase control.

2. The acoustic signal processing apparatus according to claim 1, wherein K is equal to NI.

3. The acoustic signal processing apparatus according to claim 1, wherein said determinant generation unit includes:

a first determinant generation unit operable to generate each coefficient of the first determinant of said first matrix arithmetic unit from a parameter updated for each of the frames separated by the predetermined time interval;

a second determinant generation unit operable to generate each coefficient of the second determinant of said second matrix arithmetic unit from the parameter; and an interpolation unit operable to calculate each of the coefficients of the second determinant of said second matrix arithmetic unit by sequentially performing interpolation using a parameter of an immediately preceding frame or each coefficient of a second determinant of the immediately preceding frame, and wherein said first matrix arithmetic unit is operable to perform matrix arithmetic directly using the first determinant, the coefficients of the first determinant being generated by said first determinant generation unit, without interpolating values into the coefficients of the first determinant generated by said first determinant generation unit.

4. The acoustic signal processing apparatus according to claim 1, wherein said K decorrelation units are operable to perform a process to rotate a phase of an input signal by 90 degrees.

5. An acoustic signal processing method for converting down-mixed acoustic signals of NI channels to acoustic signals of NO channels, where NO>NI, using spatial information parameters updated for each of a plurality of frames separated by a predetermined time interval, said acoustic signal processing method comprising:

a first matrix arithmetic step of performing, using a processor, matrix arithmetic for the down-mixed acoustic signals of the NI channels;

K decorrelation steps of generating, with respect to output signals of said first matrix arithmetic step, signals which are incoherent, in terms of time characteristics, with the signals obtained after the matrix arithmetic performed by said first matrix arithmetic step, while maintaining frequency characteristics of the signals obtained after the matrix arithmetic performed by said first matrix arithmetic step;

a second matrix arithmetic step of (i) performing matrix arithmetic for output signals of said K decorrelation steps and the down-mixed acoustic signals of the NI-channels for which the matrix arithmetic has not been performed by said first matrix arithmetic step and which have not been decorrelated by said K decorrelation steps, and (ii) outputting the acoustic signals of the NO channels; and a determinant generation step of generating matrix coefficients of said first matrix arithmetic step and matrix coefficients of said second matrix arithmetic step, using the spatial information parameters, wherein a determinant is generated for each of the plurality of frames in said determinant generation step so that a first determinant in said first matrix arithmetic step has K rows and NI columns, and a second determinant in said second matrix arithmetic step has NO rows and (NI+K) columns, wherein the first determinant with K rows and NI columns of said first matrix arithmetic step is formed only by minimum-unit coefficients that are related to gain control and are necessary for said K decorrelation steps, the minimum-unit coefficients being obtained by separating (i) coefficients that are related to the gain control and are necessary for said K decorrelation steps from (ii) coefficients related to the gain control, and wherein the second determinant with NO rows and (NI+K) columns of said second matrix arithmetic step is formed by coefficients which are obtained by combining (i) coefficients that are related to the gain control and are unnecessary for said K decorrelation steps and (ii) coefficients related to phase control.

6. A non-transitory computer readable recording medium having stored thereon a program, wherein, when executed, said program causes a computer to execute the acoustic signal processing method according to claim 5.

* * * * *